US006836089B2

(12) United States Patent
Siebert

(10) Patent No.: US 6,836,089 B2
(45) Date of Patent: Dec. 28, 2004

(54) INSTALLATION FOR PRELIMINARY CRUSHING OF ARTICLES

(75) Inventor: Jean-Pierre Siebert, Saint Valerien (FR)

(73) Assignee: CFF Recycling, Paris (FR)

( * ) Notice: Subject to any disclaimer, the term of this patent is extended or adjusted under 35 U.S.C. 154(b) by 96 days.

(21) Appl. No.: 10/307,672

(22) Filed: Dec. 2, 2002

(65) Prior Publication Data

US 2003/0102827 A1 Jun. 5, 2003

(30) Foreign Application Priority Data

Dec. 5, 2001 (FR) ..... 01 15699

(51) Int. Cl.[7] ..... B02C 25/00
(52) U.S. Cl. ..... 318/434; 241/36; 318/475
(58) Field of Search ..... 318/9, 434, 475; 241/31, 32, 33, 36

(56) References Cited

U.S. PATENT DOCUMENTS 3,796,151 A * 3/1974 Williams ..... 100/233
4,188,876 A * 2/1980 Graves ..... 100/232
4,346,850 A 8/1982 Westergaard
4,625,636 A * 12/1986 Woods et al. ..... 100/35
5,797,548 A * 8/1998 Tamura et al. ..... 241/35
5,803,376 A * 9/1998 Koyanagi et al. ..... 241/36

FOREIGN PATENT DOCUMENTS

| | | | |
|---|---|---|---|
| DE | 134 921 | 4/1979 | ..... B02C/4/42 |
| FR | 2 292 520 | 11/1975 | ..... B02C/17/14 |
| WO | WO 98/07519 | 2/1998 | ..... B12C/18/24 |

* cited by examiner

*Primary Examiner*—Bentsu Ro
(74) *Attorney, Agent, or Firm*—Cohen, Pontani, Lieberman & Pavane

(57) ABSTRACT

The present invention relates to an installation for preliminary crushing of articles, the installation comprising at least a first shaft for driving articles and a second shaft for shredding driven articles, each of said shafts being provided with shredding teeth and each being rotated by at least one motor, a gearbox for reducing the speed of each motor being placed between each motor and the associated shaft, the installation further comprising both means for controlling said motors in association with sensors for picking up operating parameters of the installation, and data acquisition and processor means. According to the invention, the installation further comprises a universal joint disposed between the outlet shaft of each motor and the inlet shaft of each gearbox, and wherein each gearbox is mounted to stand on shock absorber means, thus enabling the energy created by impacts and/or torques above a given threshold at the teeth to be absorbed.

13 Claims, 4 Drawing Sheets

FIG.1 PRIOR ART
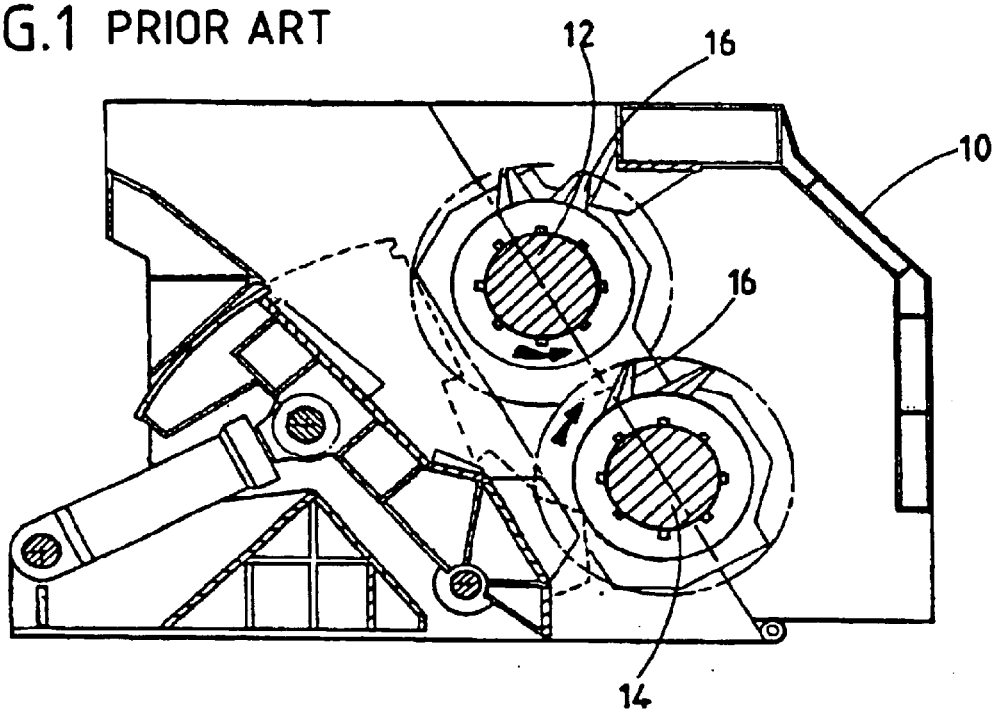
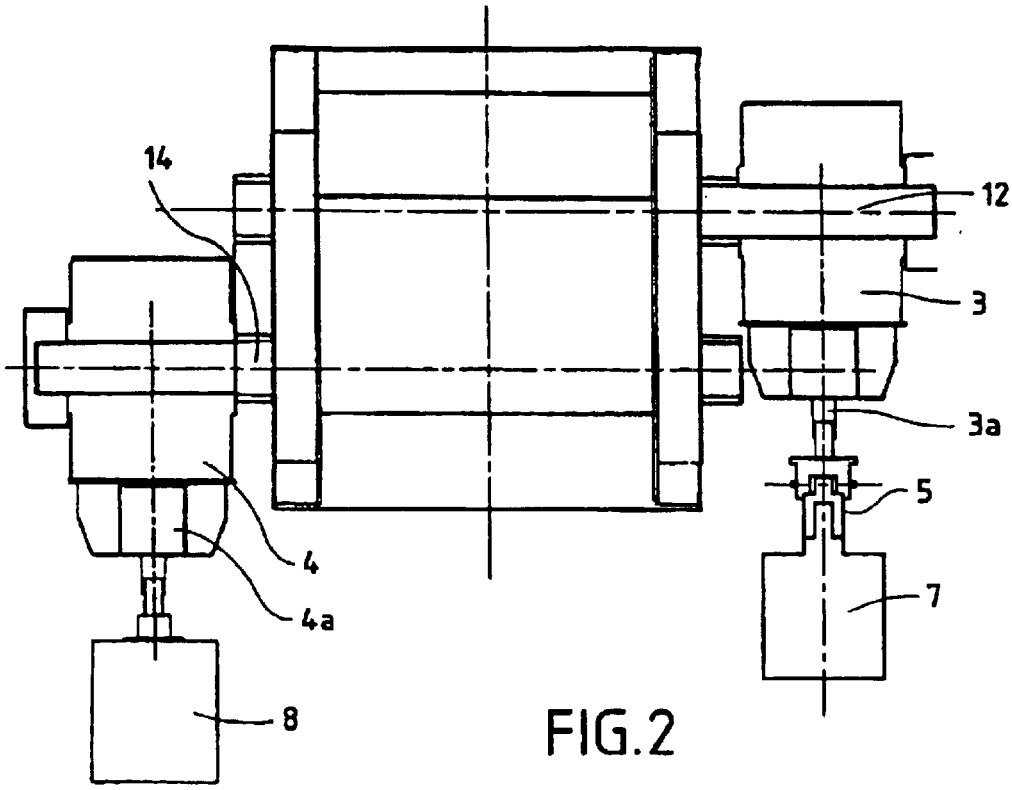
FIG.2

FIG.7
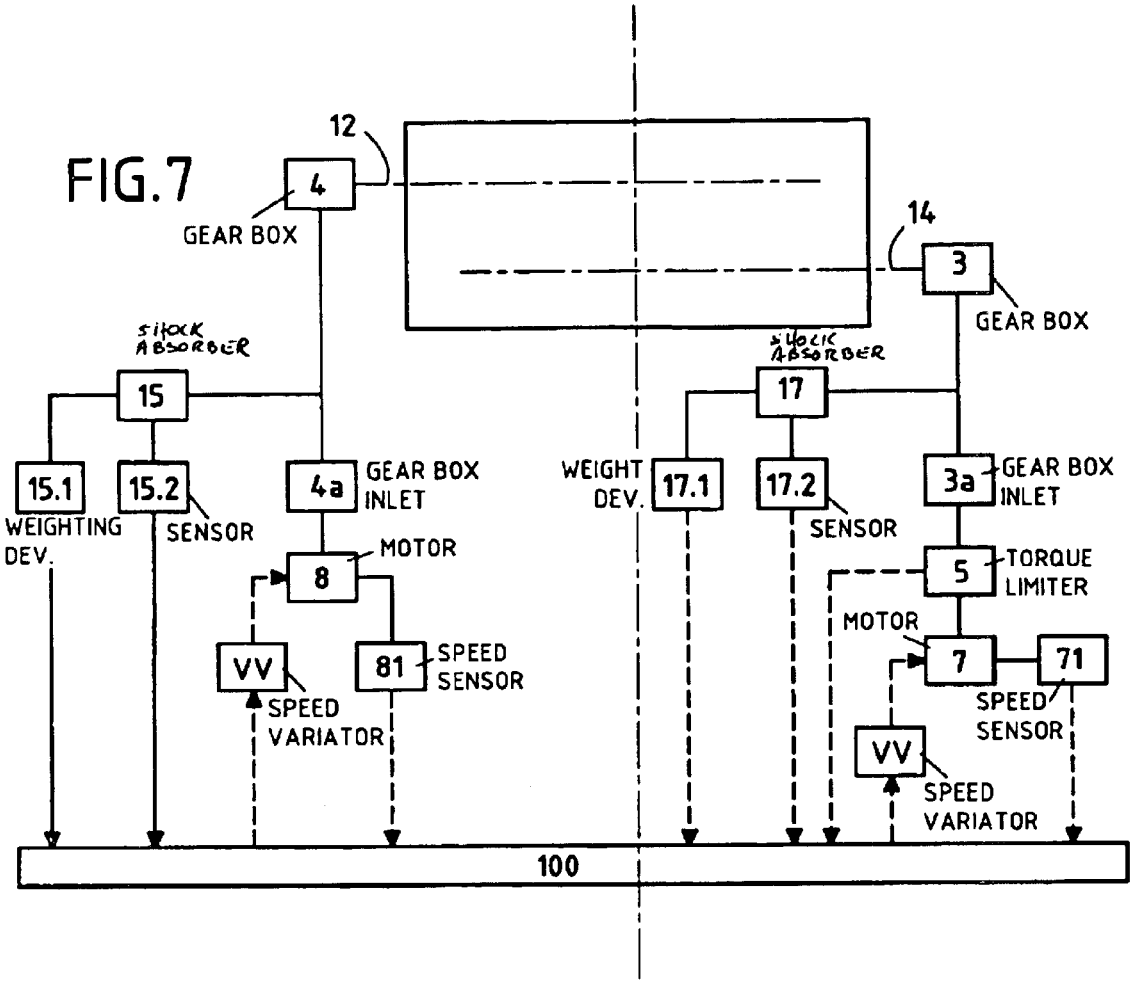
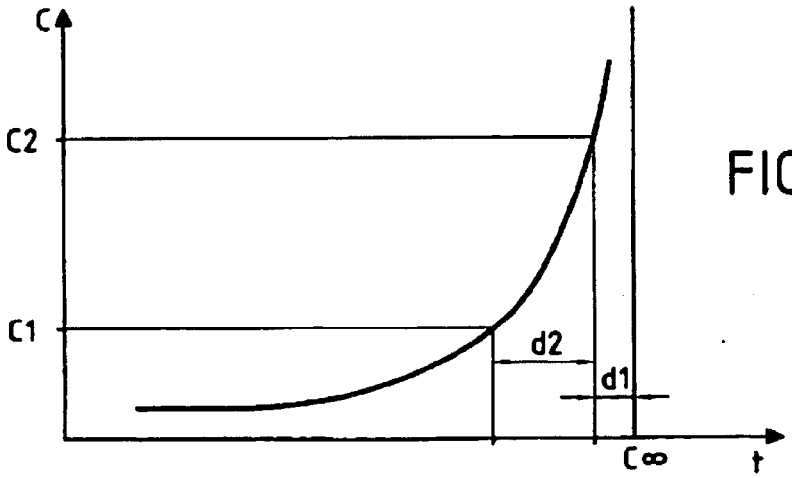
FIG.8

INSTALLATION FOR PRELIMINARY CRUSHING OF ARTICLES

BACKGROUND OF THE INVENTION

The present invention relates to an installation for preliminary crushing of articles, and particularly but not exclusively vehicle wrecks and the like.

In order to recover materials and in particular metals from motor vehicle wrecks or the like, in particular, it is known to make use of crushing installations.

The operation of such a crusher unit is subject to various risks, such as explosions, fire, machinery being broken, etc. These incidents are mainly caused by inserting into the crusher, in amongst the wrecks, hollow bodies such as tanks, gas cylinders, vessels containing liquid petroleum gas (LPG), or solid pieces.

For transporting car wrecks to be profitable, recycling professionals need to begin by compressing the wrecks. The packets obtained in this way present various drawbacks in terms of processing performed by crushing. Firstly, given their density and hardness, the packets are difficult for a crusher to absorb. Secondly, such packets may contain hollow bodies which run the risk of leading to explosions during crushing. The risk of explosion is also present when processing car wrecks that have not been compressed, for example fuel may be present in the tanks.

To solve that problem, proposals have been made to use preliminary crushers which are intended to prepare wrecks whether compressed or non-compressed, prior to crushing proper, by subjecting them to preliminary shredding. This operation considerably increases the productivity of crushers and it eliminates the risk of explosions.

Preliminary crushers operate on the basis of passing materials for pre-shredding between two shafts carrying shredding teeth and turning at different speeds.

Accompanying FIG. 1 is a diagram of such a preliminary crusher of known type.

Within an enclosure 10, there are two mutually parallel horizontal shafts 12 and 14 provided on their peripheries with shredding teeth such as 16. A bottom shaft 14 serves essentially to drive the articles or substances that are to be prepared for crushing, and a top shaft 12 co-operates in rotation with the shaft 14 and actually performs preliminary crushing, given that the two arms rotate in opposite directions and have different speeds of rotation.

The shafts 12 and 14 can be rotated by means of a single motor driving one of the shafts directly, with a gearing system then serving to drive the other shaft.

An improvement to that drive, as disclosed in patent application WO 98/07519, consists in using two drive motors each associated with a respective one of the shafts 12 and 14, said motors being controlled independently as a function of various operating conditions of the installation.

That improves the efficiency of the installation since continuous monitoring over certain operating parameters makes it possible to adapt better to external conditions: the nature of the fill, the speed of filling, etc.

Nevertheless, that type of installation presents problems associated with very frequent "cobbles" due to massive bodies being introduced into the preliminary crusher of a kind liable to break the teeth 16, the shafts, or other parts of the installation. In addition, cobbles can cause an entire installation to be stopped; in any event, once too many of the teeth 16 have been destroyed or damaged, the corresponding shaft needs to be replaced, and that is harmful in terms of efficiency and thus of cost.

On that type of known installation, it has also been observed that when an article is introduced that is massive, not deformable, and/or of a size that is greater than the spacing between the two shafts 12 and 14, the system becomes jammed suddenly giving rise, in a fraction of a second, to an infinite surge of torque on the shafts.

OBJECTS AND SUMMARY OF THE INVENTION

Faced with that problem, the present invention proposes a technical solution making it possible both to reduce the inertia and to absorb the energy created by the shafts 12 and 14 being jammed suddenly and violently.

Thus, the present invention provides an installation for preliminary crushing of articles, the installation comprising at least a first shaft for driving articles and a second shaft for shredding driven articles, each of said shafts being provided with shredding teeth and each being rotated by at least one motor, a gearbox for reducing the speed of each motor being placed between each motor and the associated shaft, the installation further comprising both means for controlling said motors in association with sensors for picking up operating parameters of the installation, and data acquisition and processor means.

According to a characteristic of the invention, the installation further comprises a universal joint disposed between the outlet shaft of each motor and the inlet shaft of each gearbox, and each gearbox is mounted to stand on shock absorber means, thus enabling the energy created by impacts and/or torques above a given threshold at the teeth to be absorbed.

This feature of the invention creates elasticity between certain elements of the installation such that impacts or other incidents on the teeth do not necessarily cause all or part of the installation to be destroyed as is the case in known installations.

Surprisingly, although the installation is of considerable size and weight, a degree of flexibility is nevertheless obtained between some of its component parts.

Advantageously, the shock absorber means comprise a shock absorbing element such as a stack of Belleville washers or a hydraulic actuator.

In addition, the installation of the invention may include a safety sensor placed on each shock absorber means and connected to the data processor means which responds by stopping at least the drive motors whenever said sensors are actuated.

A safety sensor responds, in fact, to the shock absorber means being subjected to a large amount of displacement, where such displacement is due to large torque being applied to the shafts, i.e. to an incident.

Thus, the stopping of the motors due to an accidental jamming of the teeth constitutes a safety factor which is entirely necessary for proper operation of the installation.

Advantageously, at least one force sensor is located on the shock absorber means and is connected to the data acquisition and processor means.

The force sensor thus provides continuous information about the forces exerted on each shaft. This information can also be processed by the data acquisition and processor means. For example, values can be displayed in real time on a monitor screen using graphics (in particular for the slow shaft and for the fast shaft) and all of the data can be transcribed by means of a printer.

In accordance with the invention, the installation further comprises decoupler means for separating at least one of the shafts from the associated drive motor.

This is to reduce inertia between at least one of the shafts and the associated motor, in particular in the event of a violent impact between the two shafts. The decoupler means thus perform a function of protecting the drive motors against torque surges, e.g. created by a violent impact.

More precisely, the decoupler means comprise at least one torque limiter.

If only one torque limiter is to be included in the installation, then it is preferably mounted on the second shaft (the shredding shaft) so as to protect the transmission system that operates at the higher speed of rotation and on which the torque created by a jam is greater.

Nevertheless, it is entirely possible and indeed advantageous to fit a torque limiter on each shaft system.

The torque limiter(s) thus provide a mechanical type of protection function for one or both motors in the event of a torque surge on the shafts.

Various types of sensor can be mounted in the installation of the invention.

It is possible to dispose a speed sensor on at least one of the motors (the drive motor and/or the shredding motor), said sensor being connected to the data acquisition and processor means.

In addition, a tripping detector may be provided on the decoupler means in order to monitor said tripping of the decoupler.

Naturally, these various sensors are connected to the data acquisition and processor means which, as explained below, serve not only to provide continuous monitoring and efficient and optimized control over the installation, but also present the advantage of reducing reaction time in the event of a violent impact.

This aspect relating to the safety of the installation represents an improvement that is particularly advantageous and appreciated by users.

The motors driving the shafts are preferably electric motors, i.e. DC or AC motors.

The type of motor should be selected as a function of the power it is to deliver and/or as a function of its size.

BRIEF DESCRIPTION OF THE DRAWINGS

Other characteristics, details, and advantages of the invention appear better on reading the following description made by way of non-limiting illustration with reference to the accompanying figures, in which:

FIG. 1, described above, shows the principles of a prior art preliminary crushing installation;

FIG. 2 is a plan view of a preliminary crushing installation of the invention;

FIG. 7 is a block diagram of the monitoring and control means of the installation; and FIG. 8 is a graph plotting the torque exerted on the shafts as a function of time.

MORE DETAILED DESCRIPTION

Figure 3:
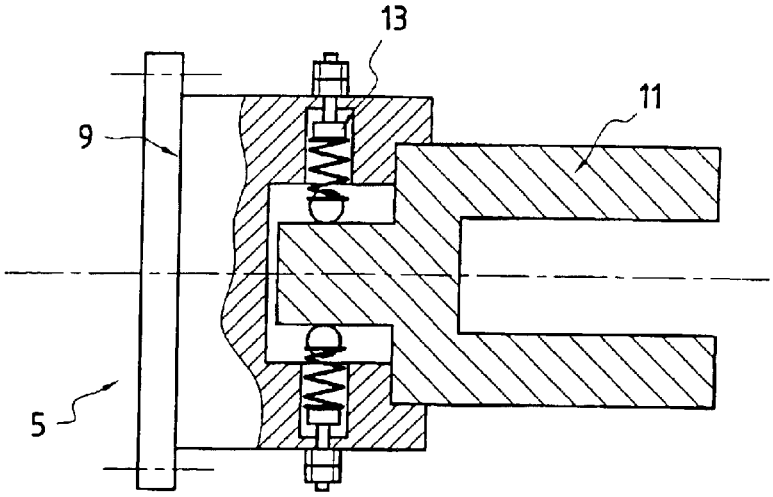
FIG. 3 is a simplified section view through a torque limiter.

FIG. 2 shows a portion of an embodiment of the invention. In this view, there can be seen the two shafts 12 and 14. The shaft 12 is the shredding shaft while the shaft 14 is referred to as the "drive" shaft. The shaft 12 revolves at a speed of rotation that is faster than that of the shaft 14. Each shaft is connected to a respective mechanical gearbox referenced 3 or 4 which preferably constitutes an angle takeoff. The inlet 3*a*, 4*a* of each gearbox is coupled to decoupler means such as a torque limiter 5, 6 whose own inlet is connected to the outlet of a respective motor 7 or 8.

Advantageously, in the event of a violent impact between the teeth 16 of the shafts 12, 14, the torque limiter 5, 6 makes it possible to decouple the motor 7, 8 from the associated gearbox 3, 4. Thus, the gearbox is no longer connected to the associated motor and these two elements can freewheel relative to each other.

An example of a torque limiter 5, 6 is shown diagrammatically in FIG. 3, where it can be seen that it comprises essentially three elements:

A hollow hub 11 coupled to the corresponding motor 7 or 8; a hub 9 for coupling to the gearbox 3 or 4; and a trip device 13 which is a cartridge that moves axially when a torque in excess of a limiting value (which can be preset) acts on the hub 9.

This axial displacement (perpendicularly to the longitudinal axis of the transmission system) has the effect of separating the two hubs 9 and 11 from each other, and thus of separating the gearbox 3 or 4, i.e. the shafts 12 or 14, from the associated motor 7 or 8.

This decoupling is mechanical in the sense that when a torque in excess of the rated value of the cartridge 13 acts on one of the hubs, then the cartridge 13 retracts into its housing, thus eliminating the mechanical connection between the hubs 9 and 11, and thus between the corresponding motor and the transmission shaft.

To re-engage the above-specified elements, the device 13 is engaged either manually, or else automatically.

As briefly mentioned above, the torque limiter 5, 6 is preferably placed in the transmission system of the shredding shaft 12 so as to provide effective protection for the motor driving this system since it is the system which is subjected not only to the higher speed of rotation, but also to the greater level of torque in the event of jamming.

Naturally, it is entirely possible and indeed recommended to provide such a load limiter in each of the transmission systems so as to protect each of the motors 7 and 8 effectively in the event of an incident; each torque limiter advantageously serves to protect the motor 7, 8 to which it is connected from the excessive vibration and twisting that is generated by jamming occurring at the shafts.

Advantageously, the torque limiter is fitted with a detector (not referenced) for monitoring whether it has been tripped, said detector itself being connected to the data processor assembly 100. It is advantageous to be informed in real time when a torque limiter trips; this information indicates that there is a problem with one of the transmission systems. In any event the stopping of both motors is linked. Furthermore, during restarting, jamming of the teeth 16 can be detected only by means of a torque limiter tripping.

Figure 4:
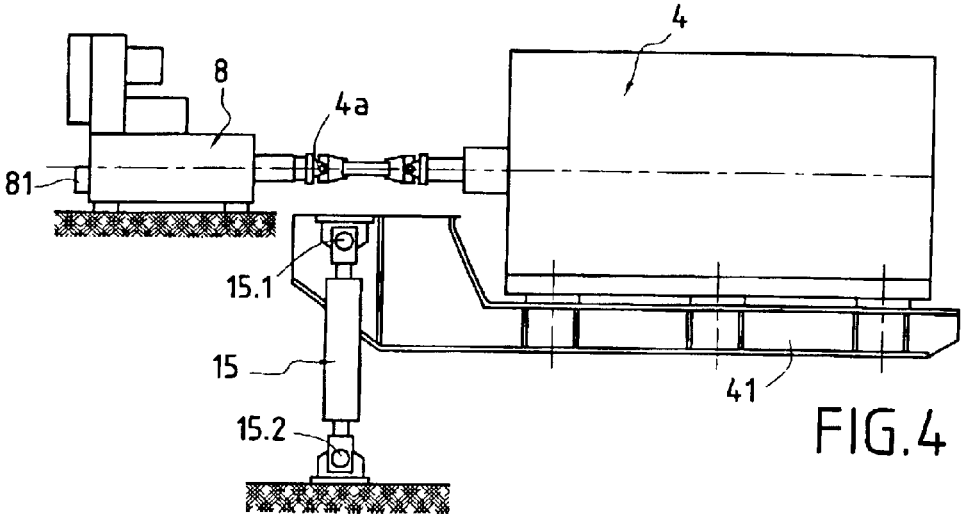
FIG. 4 is a diagram of the drive shafts system.
Figure 5:
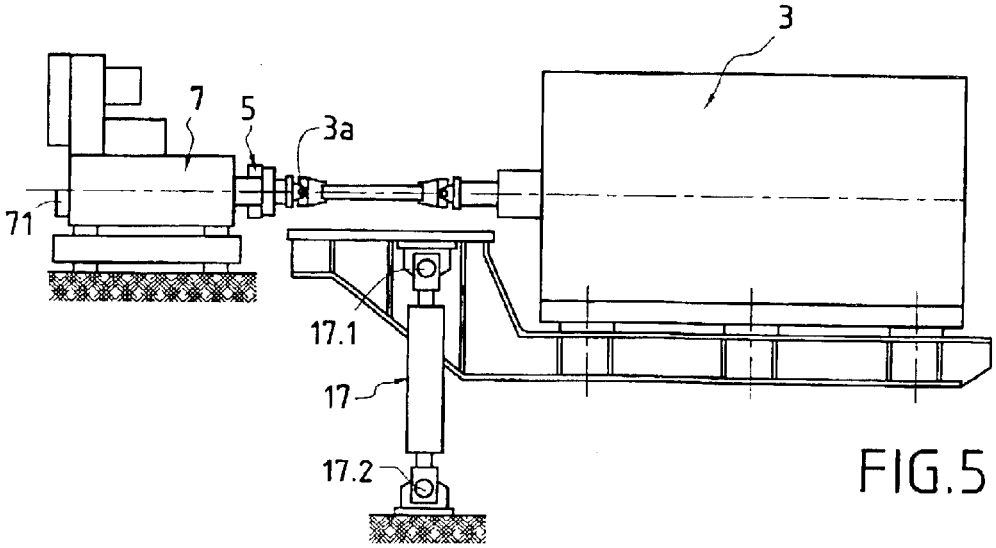
FIG. 5 is a diagram of the shredding shaft system.

FIGS. 4 and 5 show the main components of the drive shaft system and of the shredding shaft system respectively. With reference more particularly to FIG. 4:

Fixed to the motor 8 of the drive shaft there is a tachometer sensor 81 for continuously measuring the speed of rotation of said motor 8. The sensor 81 is connected to the data processor assembly 100.

The outlet shaft of the motor 8 is connected to a universal joint 4*a* which allows relative angular displacement to occur relative to the inlet shaft to the associated gearbox 4.

The gearbox 4 is supported by a support 41 which itself stands on a shock absorber system 15, also referred to as a "prop" below.

The system 15 means that the gearbox 4 is on a floating mount, i.e. it can move vertically as represented by arrows in FIGS. 4 and 5. This provides a floating assembly comprising the shaft 14, its gearbox 4, and the gearbox support 41. The fixed elements of the installation comprise the motor 8 and the foot of the prop 15. The universal joint 4*a* provides a connection between the outlet shaft of the motor (which is fixed) and the inlet shaft of the gearbox (which is floating) in the transmission system.

Furthermore, the prop 15 includes a weighing device 15.1 for continuously measuring the force on the gearbox 4. The device 15.1 is connected to the data acquisition and processor circuits 100 which can thus continuously monitor the torque applied to the shaft in question.

Finally, the prop 15 has a safety sensor 15.2 which, in the event of the gearbox 4 moving through a distance greater than a given threshold, delivers this information to the means 100 which responds by at least stopping the motors 7 and 8.

More precisely, each sensor 15.2 can be constituted by two contactors responding respectively to excessive positive or negative displacement of the prop on which they are fixed, as explained below in greater detail with reference to FIG. 6.

All of the elements described above both in terms of structure and in terms of mutual arrangement are also to be found on the system for the shredding shaft 12, as shown diagrammatically in FIG. 5.

Thus, the motor is referenced 7, the associated speed sensor is referenced 71, the universal joint 3*a*, the prop 17 (identical to the prop 15), and it carries the weighing sensor 17.1 and the displacement sensor 17.2.

This system also has means 5 for separating the outlet shaft of the motor 7 from the remainder of the system in the event of a violent impact occurring in the gap between the shafts 12 and 14.

This avoids any unacceptable torque being applied to the shafts 12, 14 and thus avoids the consequences that would result therefrom as mentioned at the beginning of this description. The means 5 serve to "protect" the motor 7 to which it is connected by not transmitting unacceptable torque thereto as can be generated by the corresponding transmission shaft.

It will be understood that in this preferred embodiment, each assembly constituted by a shaft and a gearbox associated therewith is mounted to float relative to the ground by means of the prop, but that these two assemblies are independent of each other.

Figure 6:
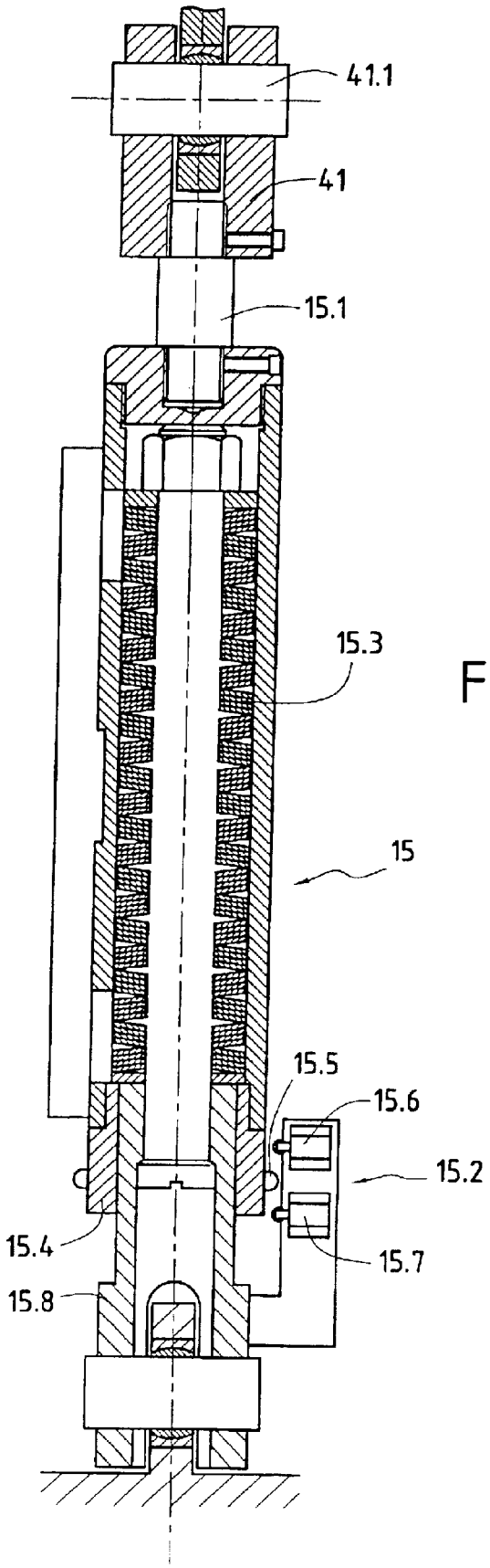
FIG. 6 is a longitudinal section through a shock absorber system of the invention.

FIG. 6 shows greater detail of a preferred embodiment of the shock absorber system or prop 15 on which one of the gearboxes (e.g. 4) stands, or more precisely the support 41 for the gearbox 4.

Above the prop 15 there is a fixing pin 41.1 of the gearbox support 41 (not shown in full) which bears against the above-mentioned force sensor 15.1.

The support 41 and the force sensor 15.1 are supported by the cylinder of the shock absorber device 15. The device may comprise a stack of Belleville washers 15.3 acting as shock absorbers.

Without going beyond the ambit of the invention, it would be possible to use a hydraulic actuator or any other shock absorber support instead of the Belleville washers.

This system is connected in translation at its bottom end to a piece 15.4 which has external studs 15.5 which, depending on their actual position, make contact either with a top end-of-stroke contactor 15.6 or with a "bottom" end-of-stroke contactor 15.7. Together this constitutes the "safety" contactor 15.2 mentioned above, and connected to the data acquisition and processor means 100.

The part 15.4 is thus capable of sliding on the foot 15.8 of the prop by an amount which depends on the forces transmitted by the gearbox. The foot is securely fixed to the bedplate supporting the preliminary crusher or it is connected to the ground by an intermediate beam.

Naturally, a prop 17 that is structurally similar to the prop 15 as described above supports the other gearbox 3 in the same manner as the prop 15 supports the gearbox 4.

As shown in FIG. 7, the data acquisition and processor circuits 100 serve both to acquire data coming from the various speed, force, and torque sensors and to acquire parameters associated with operation of the installation. This acquisition takes place continuously.

Furthermore, the circuits 100 process this data, calculate other data, and also serve to control each of the motors 7, 8 as a function of the data received, with this taking place almost instantaneously.

More precisely, the circuits 100 control at least one speed varying unit (VV) connected to the motor 7 of the drive system, and preferably each of the motors 7 and 8 is subjected to individual control via a respective speed varying unit.

The motors are stopped either under manual control, or else as a result of an incident, as detected, for example, by information delivered by one of the displacement sensors 15.2, 17.2 as explained above.

Depending on the nature of the articles to be subjected to preliminary crushing, the rate of which they are being fed, etc., the information coming from the various sensors is received by the means 100 which controls the speed of rotation of each motor accordingly.

In order to understand the invention better, there follows a description of the reactions of the various component means of the invention in chronological order:

In the event of an incident, i.e. when a "non-compressible" article of dimensions greater than the spacing between the shafts 12 and 14 is driven towards the shafts, an abnormally high torque is created on each of the shafts 12 and 14 since both of them are prevented from rotating by their teeth 16 even though they continue to be driven by their respective motors 7 and 8.

Since each of the shafts 12 and 14 is connected to a gearbox that is "floating" since it is supported by a prop or shock absorber 15, 17, this force (or torque) is transmitted to each of the shock absorbers which responds by moving (upwards or downwards).

Thus, the torque exerted by the "non-compressible" article on each of the shafts 12, 14 ceases to increase any further until each of the shock absorbers comes into abutment against at least one of the sensors 15.2, 17.2. The shock absorbers 15, 17 thus serve to damp the energy created by the forces exerted on the shafts 12, 14.

The sensors 15.2, 17.2 are actuated as soon as one of the shock absorbers 15, 17 has moved through a considerable distance. These sensors 15.2, 17.2 then inform the unit 100 which responds by deactivating both motors.

If the above-mentioned incident occurs while the installation is being started, i.e. while the speeds of the motors 7 and 8 are increasing, the sensors 15.2, 17.2 will not necessarily detect the problem, and in any event they will not detect it immediately. Consequently, the excess torque is then detected in at least one of the torque limiters 5 which immediately decouples the motor 7 or 8 with which it is associated from the remainder of the transmission system.

This provides safety for the installation during transient stages, and in particular while starting.

As an illustration, motors and gearboxes having the following characteristics have served to obtain the curve plotted in FIG. 8.

On the system for the drive shaft 14, the motor 8 had power of 129 kilowatts (kW) at a speed of rotation of 820 revolutions per minute (rpm). Its maximum speed was 1130 rpm. The nominal torque from the motor was 1500 Newton meters (Nm). Its maximum torque was 1800 Nm. The associated gearbox 4 delivered a speed of rotation of 2.6 rpm and was capable of withstanding a maximum outlet torque (acceptable in terms of deformation) of $10^6$ Nm.

On the system for the shredding shaft 12, the motor 7 had power of 396 kW for rotation at a speed of 980 rpm. Its maximum speed was 1350 rpm. The nominal torque of the motor 7 was 3800 Nm and its maximum torque 6000 Nm. The gearbox 3 delivered a speed of rotation of 16 rpm and its maximum outlet torque in terms of deformation was about $1.5\times10^6$ Nm.

The curve plotted in FIG. 8 shows the various levels of torque characteristic of the operation of the installation as a function of time, and there can be seen:

$C_1$ is the maximum preadjusted torque, of about 700,000 Nm;

$C_2$ is the maximum admissible torque above which the installation will be destroyed (zone D). $C_2$ is about 820,000 Nm;

for torque lying in the range $C_1$ to $C_2$, the installation is still in a "safety" zone (zone S); and below $C_1$, the installation is in its normal operation zone.

The present invention makes it possible to take preventative action before the period of duration d1 arises in which torque becomes infinite, with enormous risks of breakage. This duration is commonly about 0.1 seconds (s).

In prior installations, the period d2 during which it is possible to take action (torque between levels $C_1$ and $C_2$) preceding the period d1 is likewise about 0.1 s.

Because of the presence of the props, this duration d2 during which intervention is still possible is increased to 0.4 s.

The information provided by the invention is thus most beneficial, both in terms of safety and in terms of lifetime.

What is claimed is:

1. An installation for preliminary crushing of articles, the installation comprising at least a first shaft for driving articles and a second shaft for shredding driven articles, each of said shafts being provided with shredding teeth and each being rotated by at least one motor having an outlet shaft, a gearbox for reducing the speed of each motor being placed between each motor and its associated one of said at least first and second shafts, means for controlling said motors in association with sensors for picking up operating parameters of the installation data acquisition and processor means, a universal joint disposed between the outlet shaft of each motor and the inlet shaft of each gearbox, and wherein each gearbox is mounted to stand on shock absorber means, thus enabling the energy created by impacts and/or torques above a given threshold at the teeth to be absorbed.

2. An installation according to claim 1, wherein the shock absorber means comprises a shock absorber element.

3. An installation according to claim 2, wherein the shock absorber element is a stack of Belleville washers.

4. An installation according to claim 2, wherein the shock absorber element is an hydraulic actuator.

5. An installation according to claim 1, further comprising a safety sensor disposed on each shock absorber means and connected to the data acquisition and processor means which responds by stopping at least the drive motors when said sensors are actuated.

6. An installation according to claim 1, wherein the sensors comprise at least one force sensor placed on the shock absorber means and connected to the data acquisition and processor means.

7. An installation according to claim 1, further comprising decoupler means for separating at least one of the shafts from the associated drive motor.

8. An installation according to claim 7, wherein the decoupler means comprise at least one torque limiter.

9. An installation according to claim 8, wherein the torque limiter is associated with the second shaft.

10. An installation according to claim 8, comprising at least a second torque limiter, whereby one torque limiter is associated with each of the at least first and second shafts.

11. An installation according to claim 1, wherein the at least one motor comprises a drive motor and a shredding motor, and the sensors comprise at least one speed sensor associated with at least one of the drive motor and/or the shredding motor, and connected to the data acquisition and processor means.

12. An installation according to claim 1, wherein the sensors comprise at least one sensor placed on the decoupler means in order to monitor tripping thereof, the at last one sensor being connected to the data acquisition and processor means.

13. An installation according to claim 1, wherein said at least one motor is an electric motor, either a DC motor or an AC motor.

* * * * *